US008101890B2

(12) United States Patent
Wiseman et al.

(10) Patent No.: US 8,101,890 B2
(45) Date of Patent: Jan. 24, 2012

(54) FAN APPARENCY ARRANGEMENT FOR AN APPLIANCE

(75) Inventors: Joshua S. Wiseman, Elizabethtown, KY (US); Steve B. Froelicher, Shepherdsville, KY (US)

(73) Assignee: General Electric Company, Schenectady, NY (US)

( * ) Notice: Subject to any disclaimer, the term of this patent is extended or adjusted under 35 U.S.C. 154(b) by 722 days.

(21) Appl. No.: 12/203,811

(22) Filed: Sep. 3, 2008

(65) Prior Publication Data

US 2010/0051245 A1 Mar. 4, 2010

(51) Int. Cl.
*A21B 1/00* (2006.01)
*F24C 3/02* (2006.01)

(52) U.S. Cl. ..... 219/399; 219/201; 219/209; 219/210; 219/218; 219/400; 392/347; 392/370; 392/371; 165/61; 165/104.33; 165/104.34; 126/21 A; 126/273 R

(58) Field of Classification Search ..... 219/201, 219/209, 210, 218, 399, 400; 392/347, 370, 392/371; 165/61, 104.33, 104.34; 312/695, 312/21 A; 126/21 A, 273 R
See application file for complete search history.

(56) References Cited

U.S. PATENT DOCUMENTS 3,677,329 A 7/1972 Kirkpatrick
6,104,003 A * 8/2000 Jones ..... 219/400
6,127,663 A 10/2000 Jones

FOREIGN PATENT DOCUMENTS

GB 1 392 460 4/1975

* cited by examiner

*Primary Examiner* — Shawntina Fuqua
(74) *Attorney, Agent, or Firm* — Global Patent Operation; Douglas D. Zhang

(57) ABSTRACT

A fan apparency arrangement for an appliance having a fan for moving air in an interior of the appliance, including a pipe disposed in the airflow path of the fan and having first and second ends; a heater disposed in the pipe, the heater being energized when the fan is turned on; and a thermal switch disposed in the pipe, the thermal switch being closer to the first end than the heater. The fan is operative in normal operation to move air in the pipe in a direction from the first end to the second end. The pipe is disposed so that when the fan fails to move air in the pipe after turned on, air heated up by the heater passes the thermal switch in a direction from the second end to the first end so that the thermal switch is activated to signal malfunction of the fan.

17 Claims, 3 Drawing Sheets

FAN APPARENCY ARRANGEMENT FOR AN APPLIANCE

BACKGROUND OF THE INVENTION

The present invention relates generally to a fan apparency arrangement. More particularly, the present invention relates to a fan apparency arrangement for an appliance and an appliance incorporating such a fan apparency arrangement.

Appliances such as cooking ranges and wall ovens are widely used. A cooking range typically includes an oven with a front-opening access door, and at least one heating element for heating up the inside of the oven cavity. Wall ovens have a similar configuration. As is known in the art, when energized, the heating element can heat up the inside of the oven cavity to a relatively high temperature. Also as is known in the art, such cooking appliance often has a fan which is used to draw cooling air into the interior of the appliance to cool a structural component of the appliance, such as the front-opening access door, or a heat sensitive component such as an electronic control. If an appliance employs a fan for cooling, some certification institutions, such as Underwriters Laboratories Inc. (UL), require that a fan apparency device (FAD) be employed to determine or detect whether the fan is working properly.

As is known in the art, in appliances relying upon a fan for cooling airflow, when a user selects or chooses a heating operation of the appliance and turns on the appliance, the turning-on also turns on the fan. The FAD then determines or detects whether the fan is working properly. If the fan is working properly, the FAD enables the selected heating operation of the appliance to proceed. On the other hand, if the fan is not working properly, the FAD prevents the selected heating operation of the appliance from proceeding.

Various types of FADs are used to determine or detect whether the fan is working properly. The most widely used FADs are thermal switches and sail switches. A thermal switch uses the heat from the oven to heat up a bimetal member of the switch to activate the switch when the airflow from the fan is not sufficient to cool off the bimetal member. Compared with the sail switches, the thermal switches usually have a relatively slow reaction time because it uses the heat from the oven or a heat generating component of the oven to heat up the bimetal member. As a result, the existing fan apparency arrangement using a thermal switch usually has a relatively slow reaction time.

It would be desirable to provide a fan apparency arrangement, which still uses a thermal switch but which has a much faster reaction time.

BRIEF DESCRIPTION OF THE INVENTION

As described herein, the preferred embodiments of the present invention overcome one or more of the above or other disadvantages known in the art.

One aspect of the present invention relates to a fan apparency arrangement for an appliance of the type having a fan for moving air in an interior of the appliance. The arrangement includes a pipe disposed in the airflow path of the fan and having a first end and a second end; a heater disposed in the pipe, the heater being energized when the fan is turned on; and a thermal switch disposed in the pipe, the thermal switch being closer to the first end than the heater. The fan is operative in normal operation to move air in the pipe in a direction from the first end to the second end. The pipe is disposed so that when the fan fails to move air in the pipe after turned on, air heated up by the heater passes the thermal switch in a direction from the second end to the first end so that the thermal switch is activated to signal malfunction of the fan.

Another aspect of the present invention relates to an appliance that includes a fan for drawing air into an interior of the appliance; a pipe disposed in the interior of the appliance and in the airflow path of the fan, the pipe having a first end and a second end; a heater disposed in the pipe, the heater being energized when the fan is turned on; and a thermal switch disposed in the pipe, between the first end and the heater. The fan is operative in normal operation to move air in the pipe in a direction from the first end to the second end. The pipe is disposed so that when the fan fails to move air in the pipe after turned on, air heated up by the heater passes the thermal switch in a direction from the second end to the first end so that the thermal switch is activated to signal malfunction of the fan.

These and other aspects and advantages of the preferred embodiments of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE PREFERRED EMBODIMENTS OF THE INVENTION

Figure 1:
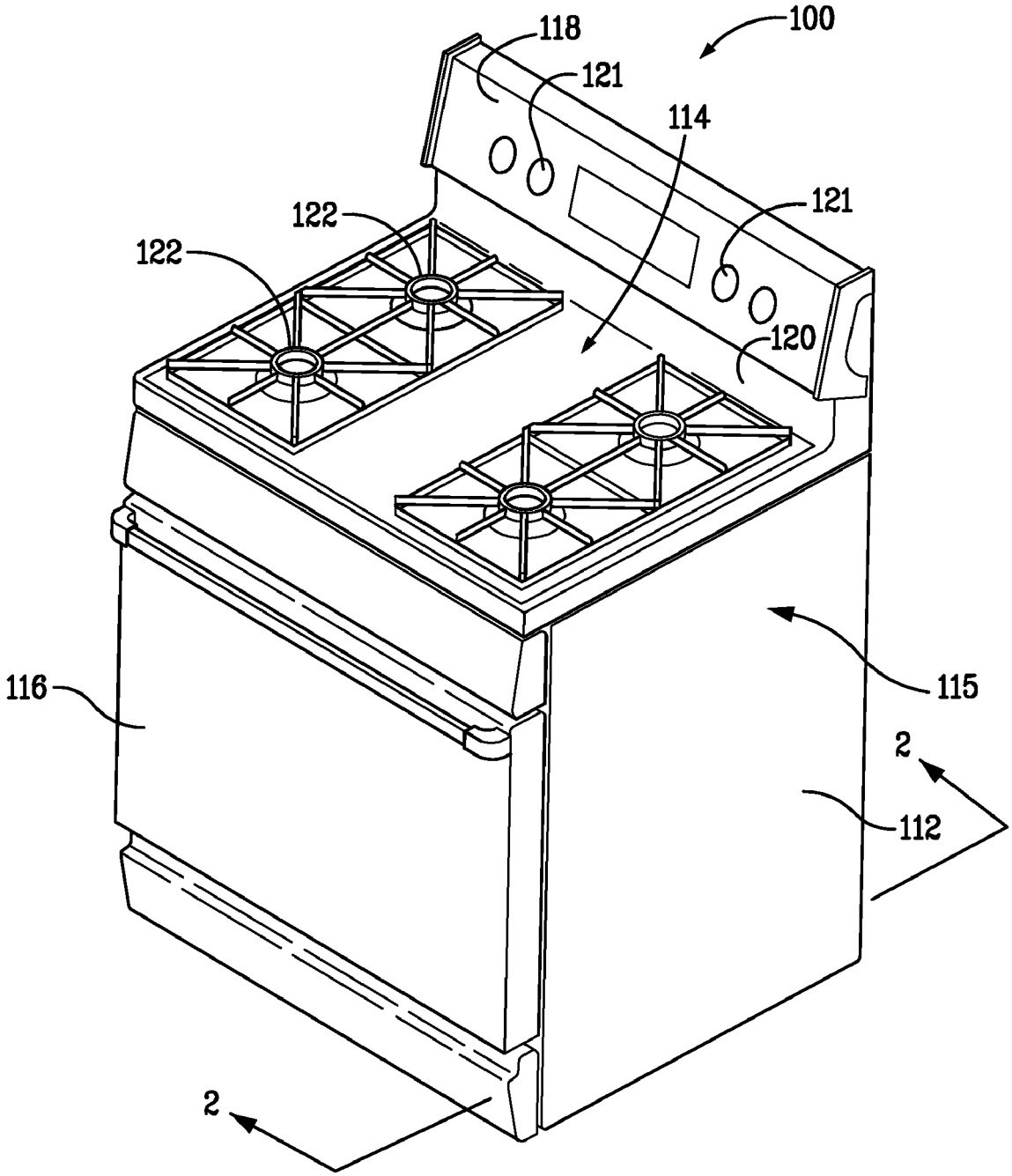
FIG. 1 is a perspective view of an exemplary cooking range incorporating a fan apparency arrangement in accordance with a preferred embodiment of the present invention.

An exemplary appliance incorporating a fan apparency arrangement in accordance with a preferred embodiment of the present invention is generally designated by reference numeral 100 in FIG. 1. By way of non-limiting example, the appliance 100 is shown as a freestanding cooking range in FIG. 1. However, the preferred embodiments of the present invention can also be used in other types of appliances such as ovens, dryers, etc.

The cooking range 100 includes an outer body or housing 112 that has a generally rectangular shaped cook top 114. An oven 115, not shown in detail, is positioned below the cook top 114 and has a front-opening access door 116 for closing the oven cavity. Preferably, an integral backsplash 118 extends upward from a rear edge 120 of the cook top 114 and contains various controls 121 for selectively operating heating elements such as gas burners 122 on the cook top 114 and heating elements (not shown) in the oven 115.

Figure 2:
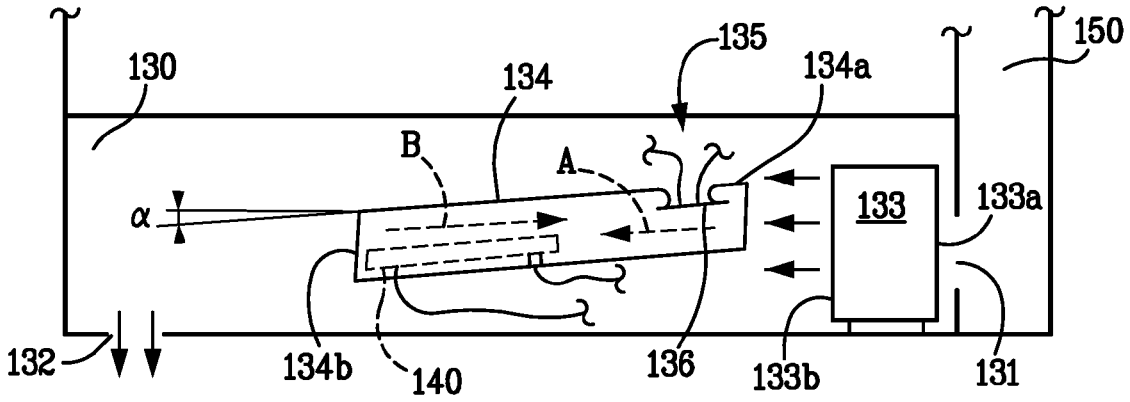
FIG. 2 is an enlarged, partial, schematic, substantially vertically cross-sectional view along line 2-2 in FIG. 1.

As shown in FIG. 2, the housing 112 has a chamber 130, which is disposed underneath the oven 115. In FIG. 2, the chamber 130 is shown in flow or fluid communication with another chamber 150. Preferably, the chamber 150 is in flow or fluid communication with the ambient air.

As clearly illustrated in FIG. 2, the chamber 130 has a first, input port 131, and a second, output port 132 that is spaced apart from the first port 131. Preferably, a fan 133 is disposed in the chamber 130 and adjacent to the first port 131. The fan 133 has an intake end 133*a* facing the first port, and an exhaust end 133*b* facing away from the first port 131. The fan 133 is operatively connected to a power source. The fan 133 is used to draw ambient or cooling air into the interior of the cooking range 100 to cool off a structural component of the cooking range 100, such as the front-opening access door 116, or a heat sensitive component such as an electronic control (not shown). The term "fan" used herein covers fans, air blowers and other devices suitable for moving air. These devices are well known in the art, and therefore will not be discussed in detail here.

Also disposed inside the chamber 130 is a guide member such as a through pipe 134. The pipe 134, which can be held in place by a support member or a fastener (not shown), is disposed between the first port 131 and the second port 132, and has a first end 134*a*, and an opposite second end 134*b* which is further away from the fan 133 than the first end 134*a*. The pipe 134 can be in any shape, such as bent, curved, etc. so long as it is positioned or configured so that the first end 134*a* is higher than the second end 134*b* so that heated air will move by convection from the second end 134*b* to the first end 134*a*. Preferably, the pipe 134 is substantially straight with a constant wall thickness so that the pipe 134 forms an acute angle $\alpha$ with the horizontal surface. The angle $\alpha$ is in the range of about greater than 0 degrees to less than 90 degrees, preferably about 5-20 degrees. More preferably, the angle $\alpha$ is approximately 8 degrees.

A thermal switch 135 is preferably affixed to the pipe 134, preferably positioned adjacent to the first end 134*a* of the pipe 134. Preferably, the thermal switch 135 is operatively connected to a control (not shown) of the oven, and the bimetal member 136 of the thermal switch 135 is disposed inside of the pipe 134. The thermal switch 135 is well known in the art, and thus will not be discussed in detail here.

A heating member such as an electrical heater 140 is preferably disposed inside, and supported by the pipe 134. The thermal switch 135 is positioned between the first end 134*a* and the heater 140. The heater 140 is preferably positioned adjacent to the second end 134*b* of the pipe 134. The heater 140 is operatively connected to a power source, and can be a 15-watt heater. The heater 140 is well known in the art, and therefore will not be discussed in detail here.

During operation, a user selects a heating operation for the oven 115 and activates the oven 115 by a start switch or dial (not shown). Activating the oven 115 in turn turns on the fan 133 and the heater 140. If the fan 133 works properly, it draws ambient or cooling air into the chamber 130 through the first port 131. The fan 133 also generates an airflow A in the pipe 134, which airflow moves in a direction from the first end 134*a* to the second end 134*b*. This airflow A ensures that air heated up by the heater 140 will move away from the thermal switch 135 and therefore will not activate the thermal switch 135. If the fan 133 malfunctions, however, there is no fan-induced airflow A in the pipe 134. However, since the first end 134*a* is positioned higher than the second end 134*b*, air around the heater 140 will be heated up, and the heated air will move along the interior surface of the pipe 134 in a direction from the second end 134*b* to the first end 134*a*. This creates an airflow B that activates the thermal switch 135 when it passes the bimetal member 136 of the thermal switch 135. Activating the thermal switch 135 prevents the selected heating operation from proceeding, and the oven 115 will generate or display an error or service needed signal for the user.

Figure 3:
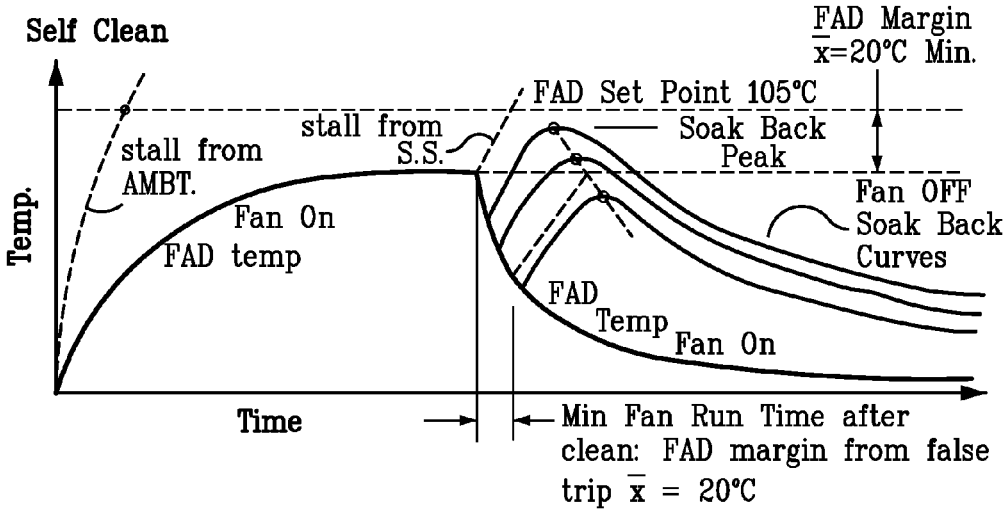
FIG. 3 illustrates the reaction times of an exemplary fan apparency arrangement of the present invention in an oven operating in a self clean mode.
Figure 4:
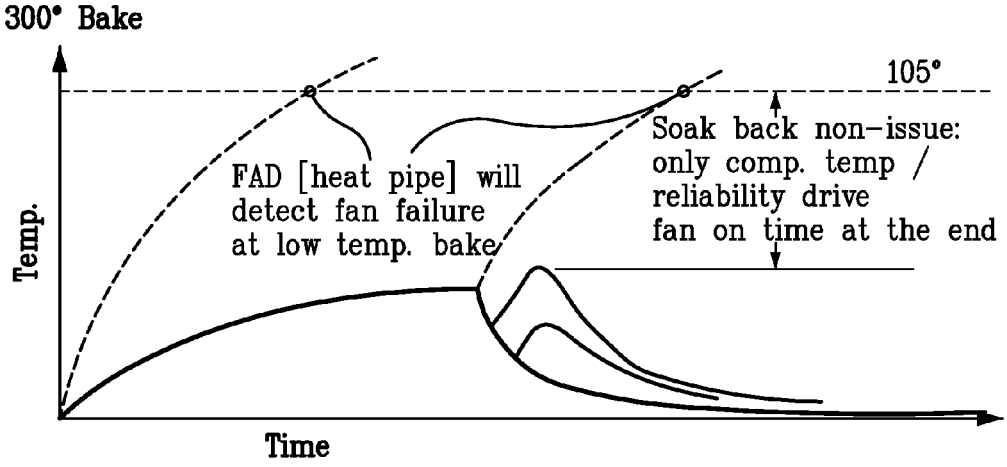
FIG. 4 illustrates the reaction times of the exemplary fan apparency arrangement in an oven operating in a bake mode.

The inventive fan apparency arrangement offers advantages. For example, as illustrated in FIGS. 3 and 4, it has a much faster reaction time in various cooking modes. In one test, the reaction time of such fan apparency arrangement is reduced by about ⅔, compared with that of a conventional fan apparency arrangement where the same thermal switch is used in the same chamber in the same position but no heater and angled pipe is used. In addition, unlike the conventional fan apparency arrangement wherein multiple FADs with different set points are needed in order to detect a stalled fan in multiple cooking modes (e.g., broil, lower temp bake, high temp bake, self clean), the inventive fan apparency arrangement uses a single FAD to detect a stalled fan in multiple cooking modes (see FIGS. 3 and 4). Moreover, the inventive FAD can have a high trip set point relative to its normal operating temperature because of the heater and the angled pipe. Furthermore, the inventive fan apparency arrangement can substantially shorten or eliminate the operation time of the fan after the oven is turned off. As is known in the art, conventional FAD mounted on insulation retainers could experience a false trip (nuisance trip) due to thermal soakback from the oven cavity and insulation retainer. The inventive fan apparency arrangement moves the FAD off the retainer and contains a separate heat source (i.e., the heater) that is turned off when the oven is not in a cooking or cleaning mode.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A fan apparency arrangement for an appliance of the type comprising a fan for moving air in an interior of the appliance, the arrangement comprising:

a pipe disposed in the airflow path of the fan and comprising a first end and a second end;

a heater disposed in the pipe, the heater being energized when the fan is turned on;

a thermal switch disposed in the pipe, the thermal switch being closer to the first end than the heater, wherein the fan is operative in normal operation to move air in the pipe in a direction from the first end to the second end, and wherein the pipe is disposed so that when the fan fails to move air in the pipe after turned on, air heated by the heater passes the thermal switch in a direction from the second end to the first end to activate the thermal switch to signal malfunction of the fan.

2. The arrangement of claim 1, wherein the first end is disposed higher than the second end.

3. The arrangement of claim 2, wherein the pipe is substantially straight.

4. The arrangement of claim 3, wherein the pipe forms an angle of approximately 5-20 degrees relative to a horizontal surface.

5. An appliance comprising:

a fan for drawing air into an interior of the appliance;

a pipe disposed in the interior of the appliance and in an airflow path of the fan, the pipe comprising a first end and a second end;

a heater disposed in the pipe, the heater being energized when the fan is turned on;

a thermal switch disposed in the pipe between the first end and the heater, wherein the fan is operative in normal operation to move air in the pipe in a direction from the first end to the second end, and wherein the pipe is disposed so that when the fan fails to move air in the pipe after turned on, air heated up by the heater passes the thermal switch in a direction from the second end to the first end to activate the thermal switch to signal malfunction of the fan.

6. The appliance of claim 5, wherein the first end is disposed higher than the second end.

7. The appliance of claim 6, wherein the pipe is substantially straight.

8. The appliance of claim 7, wherein the pipe forms an angle in the range of between greater than 0 degrees and less than 90 degrees relative to a horizontal surface.

9. The appliance of claim 8, wherein the angle is approximately 5-20 degrees.

10. The appliance of claim 9, wherein the angle is approximately 8 degrees.

11. The appliance of claim 5, wherein the thermal switch is disposed adjacent to the first end.

12. The appliance of claim 5, wherein the heater is disposed adjacent to the second end.

13. A fan apparency arrangement for an appliance comprising a fan and an air flow pathway, the arrangement comprising:

a pipe disposed in the air flow pathway of the appliance and comprising a first end and a second end;

a heater disposed in the pipe, the heater being energized when the fan is turned on;

a thermal switch disposed in the pipe, the thermal switch being closer to the first end than the heater, wherein the fan is operative in normal operation to move air in the pipe in a direction from the first end to the second end, and wherein the pipe is disposed so that when the fan fails to move air in the pipe after turned on, air heated by the heater passes the thermal switch in a direction from the second end to the first end to activate the thermal switch to signal malfunction of the fan.

14. The arrangement of claim 13, wherein the first end is disposed higher than the second end.

15. The arrangement of claim 14, wherein the pipe is substantially straight.

16. The arrangement of claim 15, wherein the pipe forms an angle of approximately 5-20 degrees relative to a horizontal surface.

17. The arrangement of claim 16, wherein the pipe forms an angle of approximately 8 degrees relative to the horizontal surface.

* * * * *